United States Patent [19]

Patel et al.

[11] Patent Number: 4,964,363

[45] Date of Patent: Oct. 23, 1990

[54] SYSTEM OF ASSEMBLY AND FILLING LARGE CABLES IN A SINGLE PASS AT A SINGLE STATION

[75] Inventors: Punam M. Patel, Rock Hill, S.C.; Bruce G. Kaemmer, Waxhaw, N.C.

[73] Assignee: Essex Group, Inc., Fort Wayne, Ind.

[21] Appl. No.: 362,173

[22] Filed: Jun. 6, 1989

[51] Int. Cl.[5] ..... B05C 3/02

[52] U.S. Cl. ..... 118/405; 156/48; 156/56; 156/148; 427/117; 427/120

[58] Field of Search ..... 156/48, 56, 148; 264/174; 427/117, 120; 118/405; 425/93

[56] References Cited

U.S. PATENT DOCUMENTS 4,690,718 9/1987 Laugs et al. ..... 156/48

4,874,442 10/1989 Watkins et al. ..... 156/48

*Primary Examiner*—Robert A. Dawson

*Attorney, Agent, or Firm*—Mark F. Smith

[57] ABSTRACT

A system and a method for converging and filling unfilled small unit cables into a single large cable in a single pass at a single station is disclosed. The single pass filling station comprises a pressure chamber in which the unfilled small pair count unit cables are filled with filling compound and the plurality of unit cables are converged into a single cable as the converged cable enters into a pressure tube where additional filling compound at at least slightly higher pressure is applied thereto. The assembled and filled large cable is then wiped of excess filling compound, wrapped, bound and collected on a take up reel.

9 Claims, 7 Drawing Sheets

SYSTEM OF ASSEMBLY AND FILLING LARGE CABLES IN A SINGLE PASS AT A SINGLE STATION

BACKGROUND OF THE INVENTION

The present invention relates to a system and a method for assembling and filling large telecommunication type cables at a single station in a single pass and more specifically, relates to an apparatus and method for both converging and filling of insulated conductor small pair count unit cables of 25, 50, or 100 insulated conductor pairs into large filled cables from 200 to 3,600 insulated conductor pairs.

An insulated conductor pair is two conductors (usually round copper), each typically insulated (coated) with high density polyethylene that are twisted together to form a single pair. Typically, the conductor is one of four (4) diameter sizes of 19, 22, 24, and 26 AWG (American Wire Gauge). Each insulated conductor pair comprises two of the same size conductors.

In one known prior method of assembling and filling large cables, the cables were filled at two distinctly separate filling stations at two separate locations. At the first station, small pair count unit cables were assembled and filled under pressure, one unit cable at a time, through a flood tank after which the unit cables were spirally wrapped with binder tape, each wrap was typically spaced 2 to 3 inches apart and then wound onto a take-up reel. After the proper number of small pair count unit cable reels were produced, they were tested and transported to a payoff bank at the second station. The payoff bank was typically a straight line group of 36 payoff stations located a few feet from each other where unit cable reels are placed on motorized spindles that maintain each unit cable under tension. At this station, the filled unit cables were unwound from their reels, fed through guiding eyelets and converged through a series of dies to form the larger cable after which the larger cable passed through a non pressurized flood tank where it was flooded with hot filling compound. After exiting the flood tank, the large cable was wrapped in polyester film, bound with binder tape, and wound onto a take-up reel.

Cables are filled with filling compound in order to remove air from the cable interstices and thus replaces the air with filling compound thereby preventing moisture from entering the finished cable and causing malfunctions such as electrical shorts.

The prior method of assembling and filling large cables, while somewhat acceptable, caused several problems. During the practice of the prior method, excess filling compound fell on the floor in the general areas of both the first and second stations. This spillage caused slippery floor conditions and thus a potentially hazardous work environment, not to mention an unsightly mess requiring the expenditure of both time and labor for cleaning up the spillage. In fact, because of this problem, some production down time resulted. Additionally, some of the excess filling compound spillage was too contaminated to be reused in the process and had to be scrapped.

Therefore, there is a need for a system and a method for assembling and filling large cables with filling compound at a single station in a single pass which prevents the filling compound from leaving the system unless contained in an assembled large cable; which provides a closed loop system so that no filling compound leaves the system; which provides for compound spillage falling back into the system for reuse and which is automatically replenished with filling compound when the supply runs low.

SUMMARY OF THE INVENTION

The present invention is a method and a system which includes an apparatus for assembling and filling large pair count cables in a single pass at a single station. Large cables have insulated conductor pair counts that range from 200 to 3,600 pairs.

The system of the present invention comprises: a payoff bank of a plurality of unfilled small unit cables mounted on reels. The unfilled unit cables are fed to a single pass filling means where the air in the cable interstices is replaced by a filling compound. Inside the single pass filling means, the unit cables are converged into a single large cable and filled with filling compound. After the assembled and filled large cable is wiped and exits the single pass filling means, the large cable is wrapped, bound and wound onto a take-up reel.

One particular aspect of the present invention is the unique single pass filling means where the plurality of small pair count bound unfilled unit cables are converged and filled with filling compound to form the filled large single cable.

The single pass filling means comprises: means for converging the plurality of unfilled small pair count unit cables into the large cable, means for filling both the small unit cables and the large cable with filling compound at high temperature and under pressure and wiping means for wiping the assembled and filled large cable as it exits the single pass filling means.

Another aspect of the present invention is the specific construction of the single pass filling means which comprises a pressure chamber having a plurality of layplates and dies therein for converging and filling the unfilled small unit cables under pressure therein and a pressure tube for filling the converged large cable under at least slightly higher pressure than in the pressure chamber therein.

Another aspect of the present invention is a method for assembling small pair count unit cables into larger pair count cables by converging the small pair count unit cables having pair counts of 25, 50, or 100 pairs that are as yet unfilled through a series of tooling dies to form the larger cable. As the small pair count unit cables pay off from a payoff bank and enter the system of the present invention, they are converged to form the larger cable while passing through a first pressure chamber and then the converged units enter a pressure tube. Both the pressure chamber and the pressure tube are flooded with filling compound at high temperature and under pressure. After being filled in the pressure tube, the assembled large pair count cable passes through a wiping die that sizes the cable and removes excess filling compound. After the wiping die, the large assembled cable exits the machine, is wrapped in polyester film and binder tape and then wound onto a take up reel.

Therefore, objects of the present invention include: to provide a system and a method of assembling and filling a large cable having from 200 to 3,600 insulated conductor pairs at a single station; to provide a system and a method of assembling and filling a large cable having from 200 to 3,600 insulated conductor pairs at a single station in a single pass; to provide a system and a method of assembling and filling large cables that is in a closed loop system; to provide a system and method of filling large cables that prevents compound spillage outside of the single pass filling means; to provide a system and method of filling large cables that automatically replenishes the filling compound as it is used in the process and to provide for the simultaneous assembly of a plurality of small pair count unit cables and the filling of the cables with filling compound at high temperatures under pressure, thereafter removing excess filling compound from the assembled large cable prior to exiting the system and wrapping the large assembled filled cable with polyester film and binder tape.

Other objects and advantages of the invention will be apparent from the following description, the accompanying drawings and the appended claims.

DESCRIPTION OF THE PREFERRED EMBODIMENT

Figure 1:
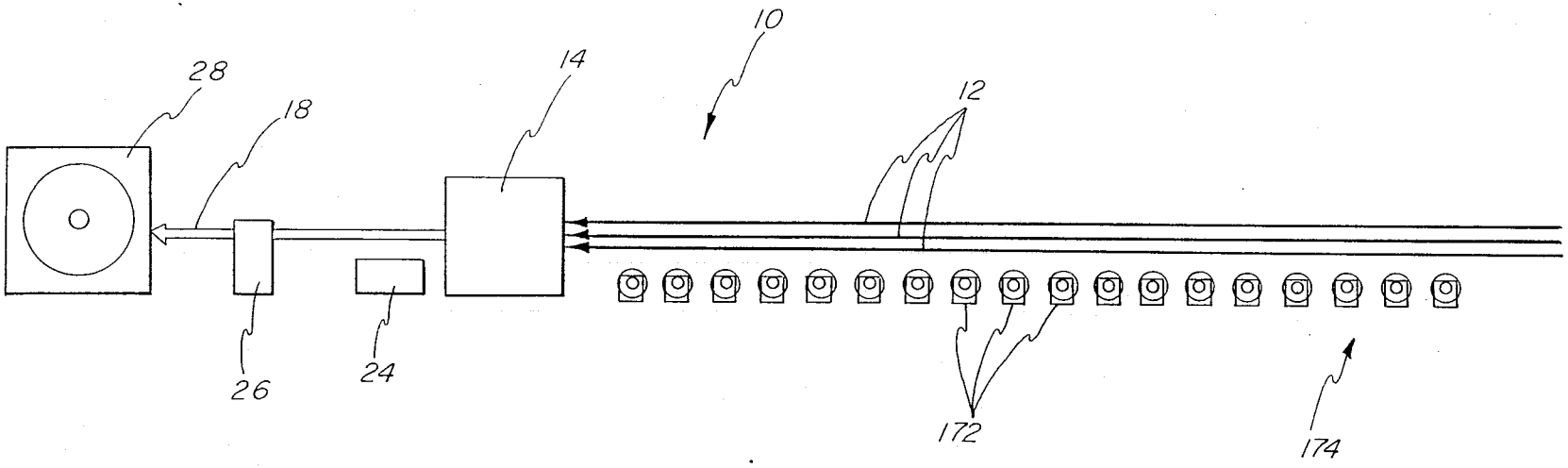
FIG. 1 is a partial schematic representation of the process and the sequence of events in the manufacture of large filled cables of the system of the present invention.

The system for assembling and filling large cables at a single location in a single pass, generally described as 10, of the present invention is illustrated in FIGS. 1–7. The system of the present invention includes: means 14 for assembling a plurality of unit cables into a single cable or single pass filling means which includes a means 16 for converging a plurality of unfilled small pair count unit cables 12 into a large cable 18; means 20 for supplying filling compound to the converging means; wiping means 22 for removing excess filling compound; wrapping means 24, 26 for wrapping the filled cable with polyester film and binder tape and a take up reel or cabler 28.

Figure 2:
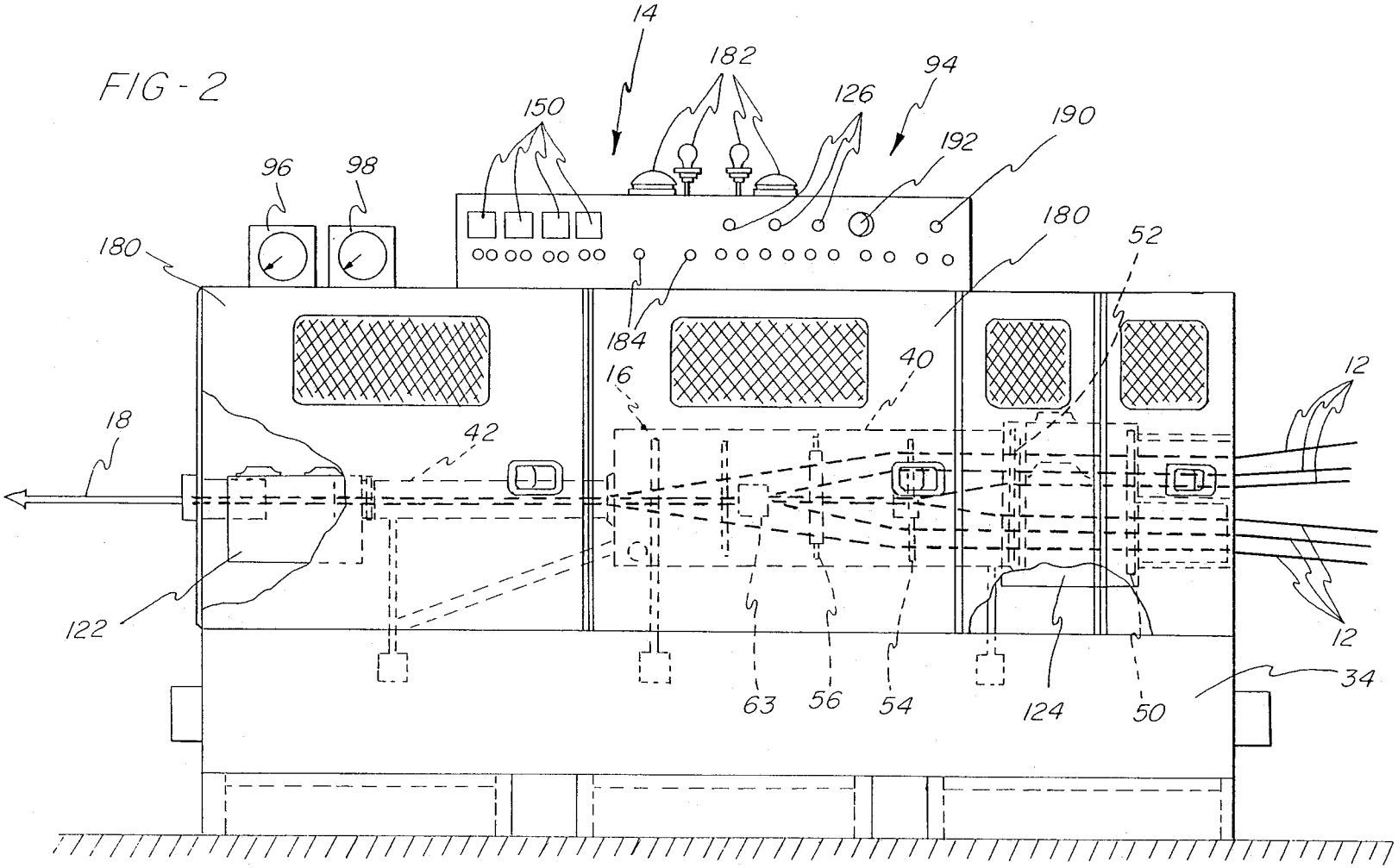
FIG. 2 is a partial front view of the present invention showing the cables and single pass filling means in phantom.
Figure 3:
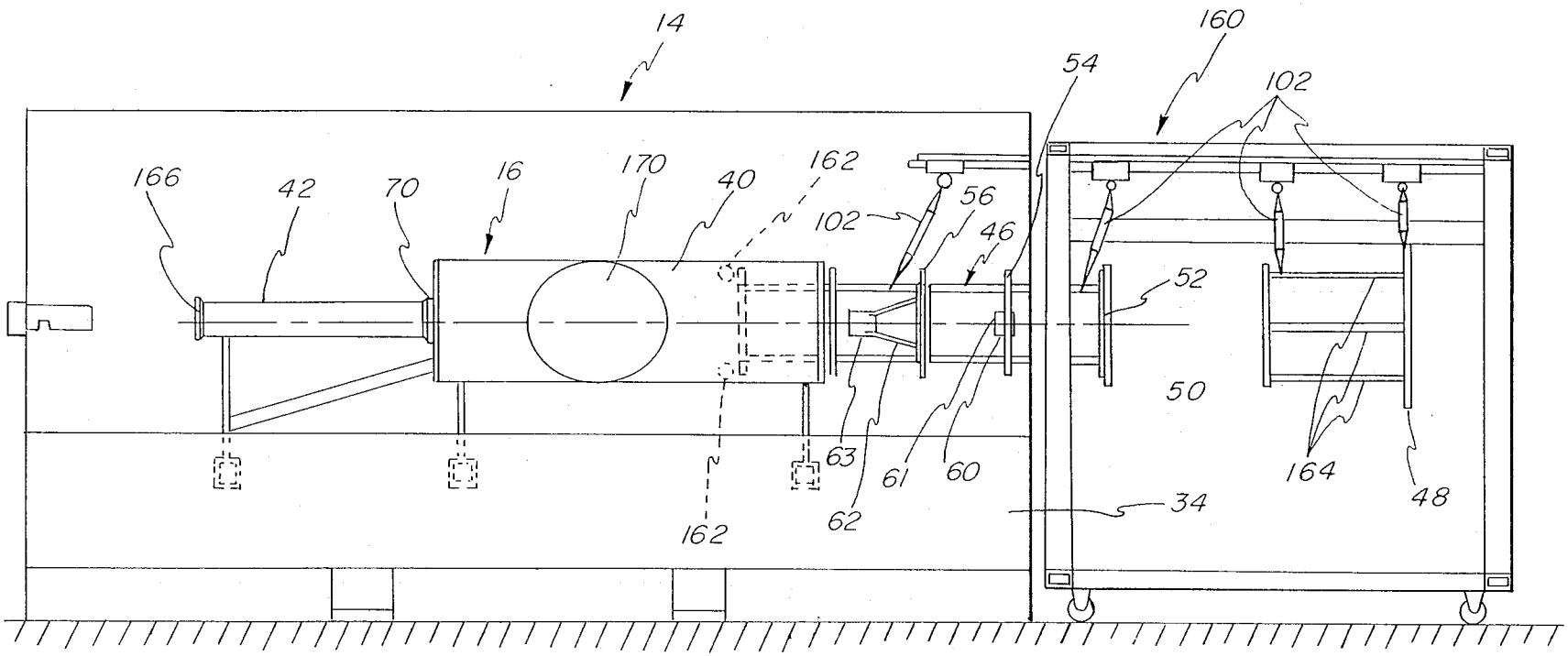
FIG. 3 is a partial front view of the present invention with the doors deleted for clarity and showing the loading of the pressure chamber.
Figure 7:
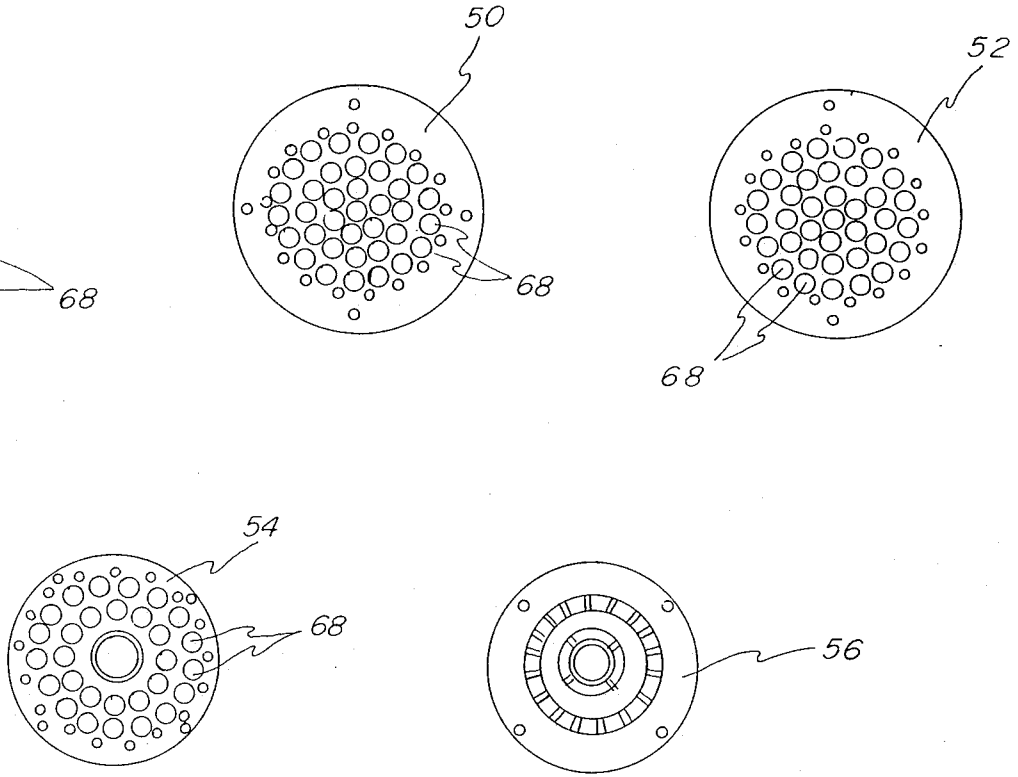
FIG. 7 is a plan view of various layplates utilized with the present invention.

As shown in FIGS. 2–3 and 7, the unit cable assembly means 14 of the present invention comprises a large capacity reservoir 34 with conventional tube heaters (not shown); a pressure chamber 40, a pressure tube 42, layplate carriage 46 with layplates 52, 54, 56, die holders 61, 62 and a plurality of dies assembled in unit cable guide apertures 68, closing dies 70, 72 and holders 74, 76, entrance die 78, wiping die 82 and holder 84, unitized pump and drive motor assemblies 90 which has couplings on a unitized mount, a control panel with various controls 94, pressure gauges with capillary tube sensors 96, 98 and an electrical enclosure with electrical and main power cutoff 100.

The system of the present invention includes a separate layplate carriage truck 46 with turnbuckles 102 used to load the die and converging apparatus into the pressure chamber 40. At the top of the pressure chamber 40 there are pressure relief valves 104. The apparatus has piping 106 that is arranged to supply filling compound to the pressure chamber 40 and pressure tube 42 from the pumps 108, 110, 112. Piping 118, 120 is also provided to replenish the reservoir with filling compound and to empty the reservoir when required such as when changing filling compounds. Splash guards 122, 124 (FIG. 2) cover appropriate locations to direct hot filling compound that is discharged under pressure from the layplate 52 and the closing die 72 down into the filling compound reservoir where it can be reused in the process. The purpose of filling cables is to prevent moisture from entering the finished cable and involves the removal of air from the cable interstices and replacing it with filling compound.

In the system of the present invention, large cables are assembled and filled by advancing small, unfilled unit cables 12 through the converging means 16 which includes a pressure chamber 40 and a pressure tube 42 where they are flooded with hot, pressurized filling compound. As the small unit cables 12 are flooded, they also converge through dies in the layplates to form the larger cable. Immediately, after the pressure chamber 40, the converged single cable enters another portion of the converging means 16 or pressure tube 42 where hot, pressurized filling compound is applied at least a slightly higher pressure before advancing through the closing die 72 and wiping die 82 before exiting the assembly means 14.

In the initial set-up to run the system, an operator assures that the main power switch 100 is on and the pumps are initially off by positioning the selector switches 126 (FIG. 2) in the off position and that 2-way valves 128, 130, 132 are in the open position. The valves 135, 136, 138, 140 remain in the closed position (FIG. 6) to insure that filling compound is pumped only to the pressure means 16. Valve 138 is only utilized for draining the pressure chamber 40 portion of the pressure means 16. Valve 136 is open only when pressure relief is desired. The reservoir 34 can be emptied of filling compound by closing valve 130 and opening valve 140 while pump 110 is running in the forward direction only. This configuration effectively bypasses the converging means 16 (pressure chamber 40 and tube 42) thereby emptying the reservoir 34 of filling compound therein by pumping the filling compound back into the piping 120 that leads to the main storage tank (not shown).

Temperature controllers 150 are switched to the "on" position and preset to maintain the proper filling compound temperature through control of the wall and tube heaters in the reservoir 34. They also allow the operator to set the filling compound temperature he wishes to maintain in the reservoir 34. The temperature controllers 150 receive a feedback signal from a thermocouple (not shown) submerged in the filling compound in the reservoir 34. Two different types of filling compound are presently used with this system. One compound requires a temperature range of 220° F.–230° F. The other compound requires a temperature range of 230° F.–240° F. to be maintained.

The reservoir 34 is automatically filled with filling compound from an external main storage tank (not shown) that supplies many filling compound flood tanks including the reservoir 34 of the single pass filling tank. A level sensor (not shown) in the reservoir 34 senses the depth of the filling compound and signals an external electric-pneumatic supply valve (not shown) to open or close and thus keep the reservoir 34 filled to the proper level. The operator visually checks to see that the reservoir is filled to the proper level before proceeding to load the proper layplate and dies into the pressure means 16.

Dies 60, 63 and layplate 52 are installed on the layplate carriage 46 outside of the single pass filling means 14 while the carriage 46 is attached to the layplate carriage truck 160 with turnbuckles 102. Layplates 52 and 50 are each preassembled with properly sized dies assembled into the unit cable guide apertures 68 for the particular cable being assembled (FIG. 7). These conventional dies (not shown) are secured to the layplates with conventional retaining rings (not shown) and can be removed if necessary. The layplate carriage 46 has roller means 162 that enable the carriage 46 to be inserted completely into and removed from the pressure chamber 40 with the aid of the layplate carriage truck 160. The layplates 54, 56 are mounted permanently to the layplate carriage 46. Splash plate 50 is mounted to the wall layplate 48 via mounting rods 164 separate from the layplate carriage 46 (FIGS. 1 and 3). Pressure tube die nuts 166 with male threads are next installed at either end of the pressure tube to secure the dies and die holders 70, 72, 74, 76, 78.

Figure 4:
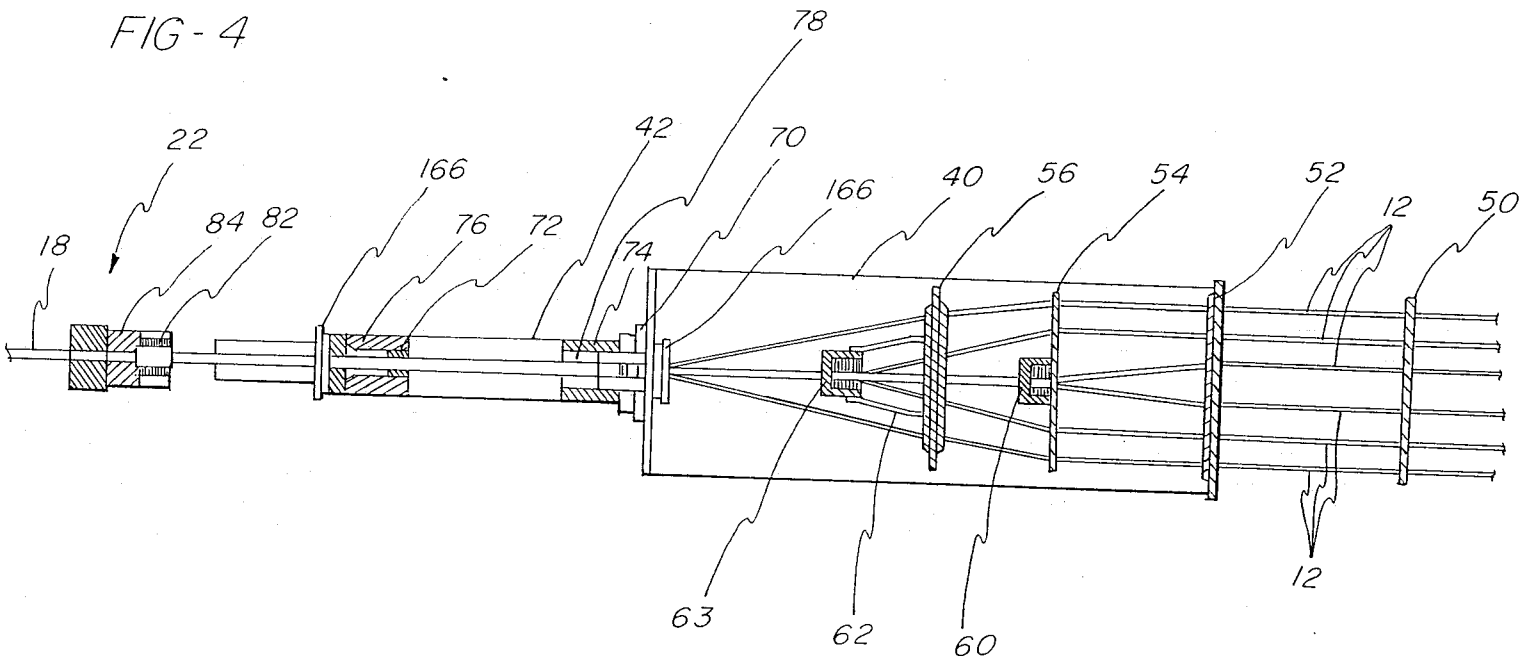
FIG. 4 is a section view of the present invention showing the pressure tube and pressure chamber and how the unit cables are assembled into the larger cable assembly.
Figure 5:
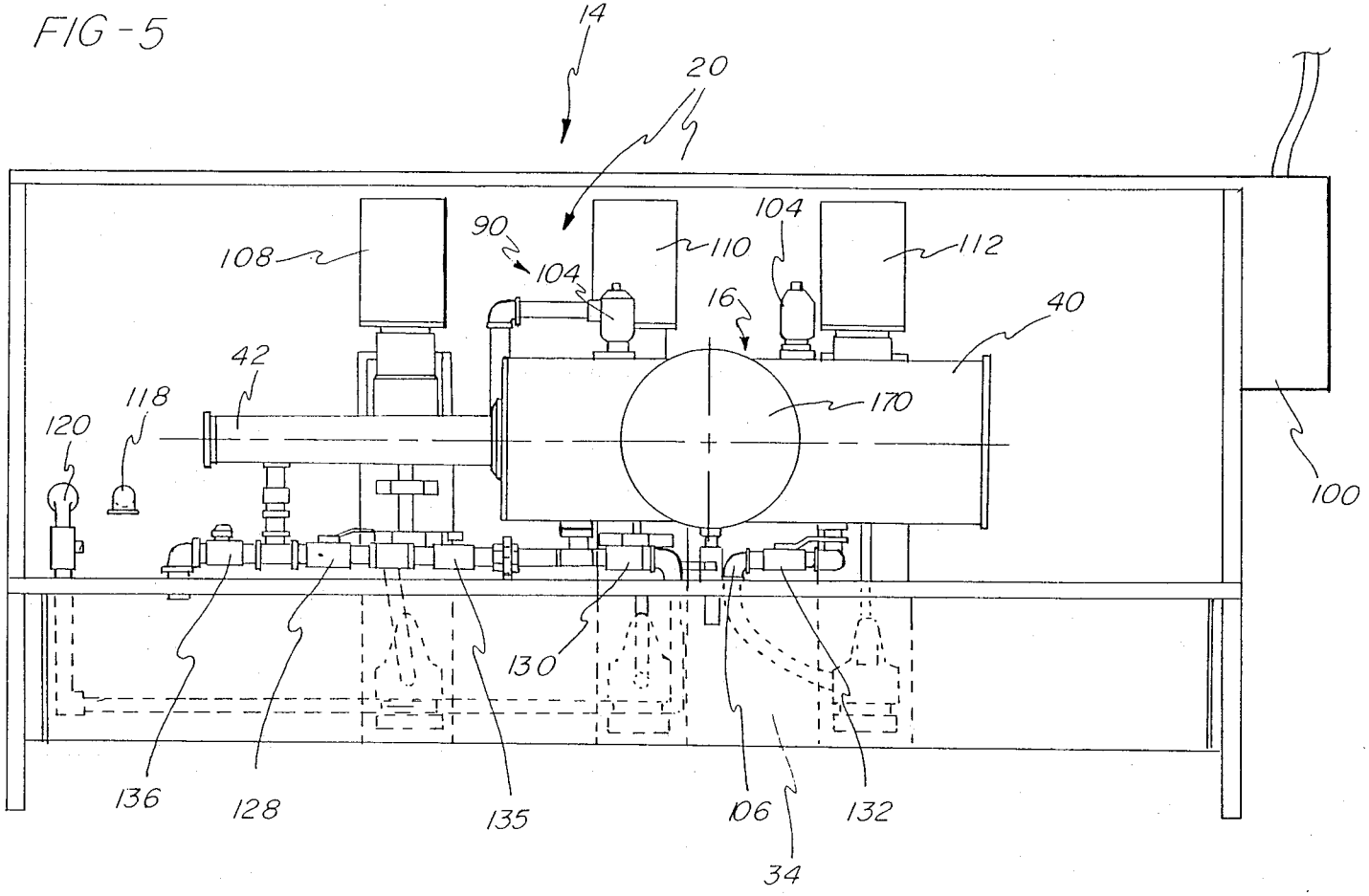
FIG. 5 is a partial front view of the present invention with doors deleted showing internal piping and pumps.

Once the dies are installed, a tow rope (not shown) is attached to the take up reel 28, threaded through the binder tape machine 26 and inserted through the wiping die 82, closing dies 70, 72 and entrance die 78 (FIG. 4). The operator then opens the pressure chamber 40 side door 170 (FIG. 5) and pulls the tow rope (not shown) completely through the pressure chamber 40 to the layplate carriage 46 which is located outside the pressure chamber 40 and attached to the layplate carriage truck 160 (FIG. 3). Unit cables 12 are next pulled from reels 172 at the payoff bank 174 (FIG. 1) and fed through the proper dies in the wall layplate 48 splash layplate 50 and the layplates 52, 54, 56 of the layplate carriage 46 (FIG. 2). After being pulled past die 63, the units are tied together and then securely attached to the tow rope (not shown). The layplate carriage 46 is then pushed into the pressure chamber 40 while simultaneously keeping the tow rope taunt to remove any slack in the tow rope. The turnbuckles 102 are detached, one at a time, until the layplate carriage 46 is completely inserted into the pressure chamber 40. The Layplate 52 is secured to the pressure chamber 40 by conventional screw clamps (not shown) that are attached to the pressure chamber 40 to seal the layplate 52 to the chamber 40. Side door 170 is then securely closed with locking screws (not shown). Wall layplate 48 is secured to the wall of at the single pass filling tank 14 with screws. Mounting rods 164 and splash layplate 50 are already attached to the wall layplate 48. The tow rope and units 12 are then pulled through successive dies (FIG. 2) and out of the single pass filling tank 14. A polyester film is then wrapped around the assembled cable and bound with binder tape before it is wound onto a take-up reel 28 (FIG. 1).

Figure 6:
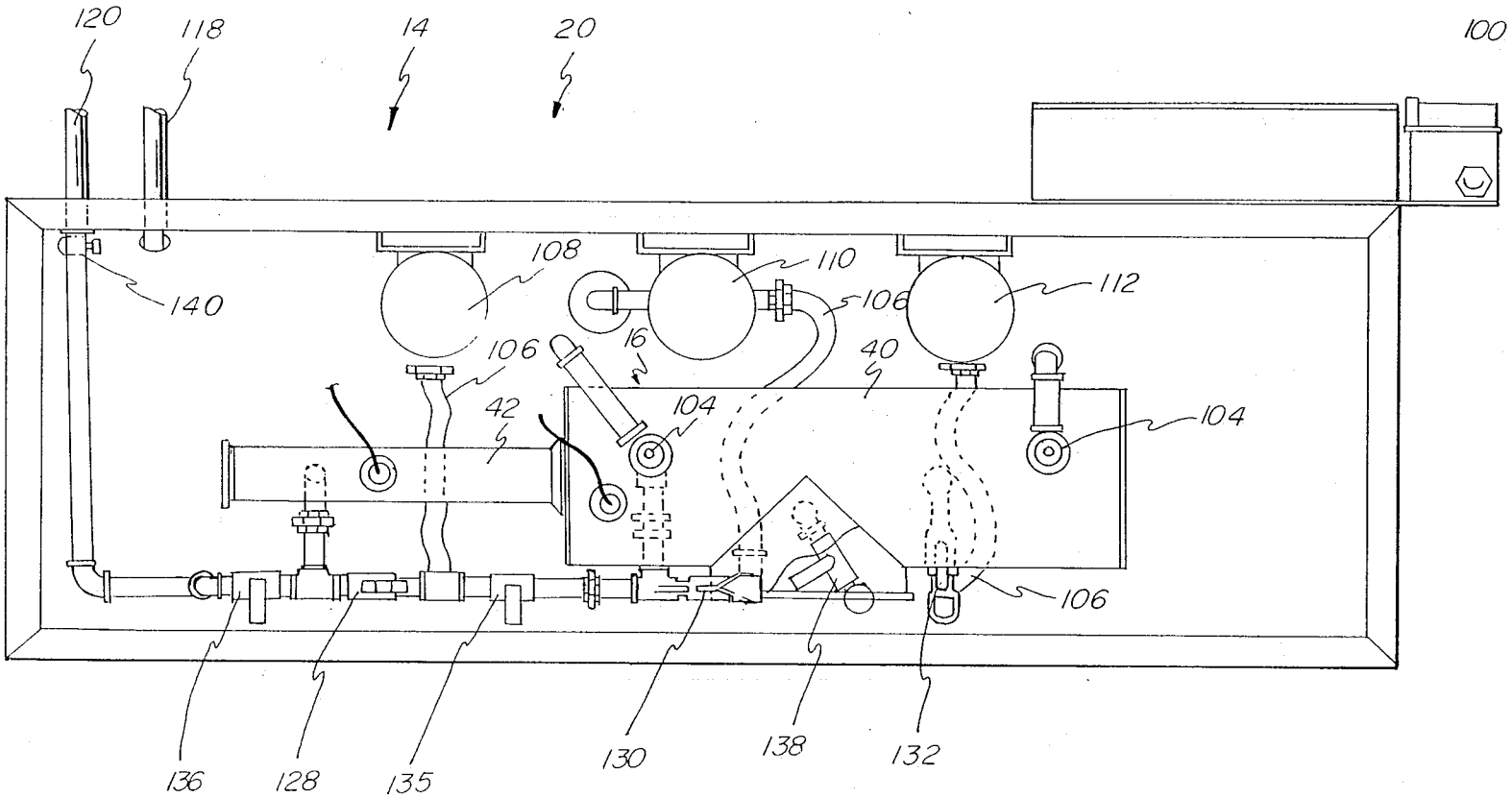
FIG. 6 is a partial top view of the embodiment of FIG. 5 with the control panel and sheet metal top removed.

The operator then installs the splash guards 122, 124 and the front sheet metal doors 180 of the single pass filling tank are closed (FIG. 2). The three pumps 108, 110, 112 are now switched to "Forward" with selector switches 126 and bell and light pressure alarms 182 are switched "on" with selector switches 184. The bell and light pressure alarms 182 are electrically interconnected with the pressure gauges 96, 98. One pressure gauge displays the pressure in the pressure chamber 40 and the other displays the pressure in the pressure tube 42. The pressure alarms 182 will remain activated until a minimum of 14 psi pressure is attained in the pressure chamber 40 and 26 psi pressure in the pressure tube 42. When the alarms 182 deactivate the operator knows that the proper minimum filling compound pressure has been attained in the pressure chamber 40 and pressure tube 42 and then will visually check to see that hot filling compound is flowing from the pressure relief valves 104 found at the top of the pressure chamber 40 (FIG. 6). The pressure relief valves 104 are set to open at 10 psi pressure and the filling compound flowing through them carries away the air that has been purged from the interstices of the unit cables 12 and replaced with hot filling compound under pressure. The interstices of the cables 12 are the spaces between the insulated conductors of the cables, that is, the spaces between the insulation diameters that have copper conductors at their cores.

Next the operator will activate the take up reel cradle (not shown) so that the assembled cable is pulled through the single pass tank 14 while simultaneously imparting a twist therein.

The control panel 94 (FIG. 2) is monitored during the cable run to assure that the proper temperatures and pressures of filling compound are maintained and that the system is functioning normally to assure the proper level of filling compound in the reservoir 34. If the level of filling compound sensor in the reservoir falls below a predetermined level, the operator may fill the reservoir manually by utilizing selector switch 190. An "emergency stop" button 192 is provided in the event that all systems need to be shut down simultaneously.

This system can also be used to assemble "aircore" cables where the pumps 108, 110, 112 are turned off and no filling compound is applied to the cable.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A system for assembling and filling a large cable at a single station in a single pass, the system comprising:

means for converging and filling with a filling compound a plurality of unfilled small pair count cables to form a large cable;

means for filling the large cable with a filling compound at high temperature under pressure; and wiping means for wiping the assembled and filled large cable as the large cable exits the means for filling the large cable.

2. The system of claim 1 further comprising;

wrapping means for wrapping a film means around the assembled filled large cable.

3. A system for assembling and filling a large cable at a single station in a single pass, the system comprising:

means for converging a plurality of unfilled small pair count cables to form a larger cable;

means for filling both the small pair count cables and the larger cable with a filling compound at high temperature under pressure; and wiping means for wiping the assembled and filled larger cable as the larger cable exits the filling means;

wherein said filling means comprises chamber means, operatively positioned in the system where the plurality of small pair count cables are converged into the large cable, for flooding the plurality of small pair count unfilled unit cables with filling compound under pressure; and tube means, operatively positioned in the system where the plurality of small pair count cables are converged into the large cable, for flooding the assembled large cable with filling compound under at least slightly higher pressure than in the chamber means.

4. An apparatus for assembling and filling a large cable from a plurality of small pair count unit cables with a single pass at a single station, the apparatus comprising:

means for converging a plurality of small pair count unit cables to form a large cable;

means for filling both the small pair count unit cables and the large cable with a filling compound at high temperature under pressure; and wiping means for removing excess filling compound from the converged and filled cable as the large cable exits the filling means.

5. An apparatus for assembling and filling a large cable from a plurality of small pair count unit cables with a single pass at a single station, the apparatus comprising:

means for converging a plurality of small pair count unit cables to form a large cable;

means for filling both the small pair count unit cables and the large cable with a filling compound at high temperature under pressure; and wiping means for removing excess filling compound from the converged and filled cable as the large cable exits the filling means;

wherein said converging means comprises a plurality of layplates having dies assembled thereon;

closing die means, operatively connected to at least one layplate, for converging the unit cables together;

die holder means, operatively connecting to the layplate and the closing dies, for operatively positioning the closing dies; and a plurality of mounting rods for maintaining the layplates in a predetermined position relative to each other.

6. The apparatus of claim 4 wherein the filling means further comprises:

pressure chamber means for applying filling compound to both the unit cables and the converged large cable;

filling compound supply means, operatively connected to the pressure chamber means and to a filling compound supply reservoir, for providing filling compound to the chamber means at a pressure sufficient to replace the air in the cable interstices with filling compound; and pressure relief means, operatively connected to the chamber means, for providing an escape path for the air replaced by the filling compound.

7. The apparatus of claim 5 wherein the filling means further comprises:

a pressure chamber, which has operatively positioned therein at least a portion of the plurality of layplate means and at least a portion of the closing die means, for filling the unit cables with filling compound as they are converged into the large cable; and a pressure tube, operatively connected to the pressure chamber, for filling the converged large cable with filling compound.

8. The apparatus of claim 7 wherein the pressure tube further comprises;

at least two closing dies and at least one entrance die, operatively positioned in the tube, for producing a filled large cable.

9. The apparatus of claim 8 wherein the filling compound supply means further comprises:

a plurality of pump means, operatively connected to the pressure chamber means, the tube means and the filling compound reservoir by piping means, for providing filling compound from the reservoir to each of the chambers and tubes means under pressure; and a plurality of valve means, operatively positioned in the piping means, for controlling the flow of filling compound to the pump means.

* * * * *